US006814309B2

(12) United States Patent
Rieger et al.

(10) Patent No.: US 6,814,309 B2
(45) Date of Patent: Nov. 9, 2004

(54) FUEL INJECTOR

(75) Inventors: Franz Rieger, Schwieberdingen (DE); Thomas Ludwig, Huenxe (DE); Hans Schlembach, Muehlacker (DE); Gottlob Haag, Markgroeningen (DE); Ulrich Brenner, Moeglingen (DE); Michael Huebel, Gerlingen (DE); Juergen Stein, Illingen (DE); Udo Sieber, Bietigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/169,962

(22) PCT Filed: Nov. 12, 2001

(86) PCT No.: PCT/DE01/04208

§ 371 (c)(1),
(2), (4) Date: Nov. 12, 2002

(87) PCT Pub. No.: WO02/38947

PCT Pub. Date: May 16, 2002

(65) Prior Publication Data

US 2003/0127543 A1 Jul. 10, 2003

(30) Foreign Application Priority Data

Nov. 11, 2000 (DE) ..... 100 56 039

(51) Int. Cl.[7] ..... F02M 59/00

(52) U.S. Cl. ..... 239/533.2; 239/533.13; 239/533.14; 239/397.5; 239/584; 137/855

(58) Field of Search ..... 239/533.2, 533.13, 239/533.14, 494, 497, 552, 75, 397.5, 584, 546, 596; 137/855; 251/11

(56) References Cited

U.S. PATENT DOCUMENTS

| | | | | | |
|---|---|---|---|---|---|
| 5,140,965 | A | * | 8/1992 | Nogi et al. | 123/494 |
| 5,570,841 | A | * | 11/1996 | Pace et al. | 239/585.1 |
| 5,619,177 | A | | 4/1997 | Johnson et al. | |
| 6,019,113 | A | | 2/2000 | Allston et al. | |
| 6,089,476 | A | * | 7/2000 | Sugimoto et al. | 239/596 |
| 6,318,641 | B1 | * | 11/2001 | Knebel et al. | 239/5 |

FOREIGN PATENT DOCUMENTS

| | | |
|---|---|---|
| DE | 30 48 304 | 7/1982 |
| DE | 31 20 044 | 12/1982 |
| DE | 32 28 079 | 2/1984 |
| DE | 198 27 219 | 1/1999 |

* cited by examiner

*Primary Examiner*—Dinh Q. Nguyen
(74) *Attorney, Agent, or Firm*—Kenyon & Kenyon

(57) ABSTRACT

A fuel injector is described, in particular an injector for fuel injection systems in internal combustion engines, that includes a valve needle having a valve-closure member which cooperates with a valve-seat surface arranged in valve-seat member to form a sealing seat and which has several injection orifices which are arranged downstream from the sealing seat, and are sealed by sealing seat against a fuel supply. A disk element is arranged downstream from the sealing seat, the disk element having at least one valve section, which changes its shape when the temperature changes. Valve section is connected to a heating element and optionally covers an injection orifice.

13 Claims, 1 Drawing Sheet

FUEL INJECTOR

FIELD OF THE INVENTION

The present invention relates to a fuel injector.

BACKGROUND INFORMATION

A fuel injector that may control several injection orifices separately is described in German Published Patent Application No. 32 28 079. The fuel injector has two valve needles which may each be acted upon with a prestressing force by a spring against a sealing seat. If one valve needle is raised from its sealing seat by a certain prelift, it may strike a stop of the other valve needle and pick up this valve needle as it continues its lift. The two sealing seats of the two valve needles may seal different injection orifices which may be oriented at different angles. However, the configuration may have multiple parts and it may be required to precisely manufacture two sealing seats, which may entail high costs. Furthermore, merely two groups of injection orifices may be controlled separately and a further selection of injection orifices to be opened may not be possible.

A fuel injector for internal combustion engines having a valve needle and an auxiliary needle arranged in a bore of the valve needle is described in German Published Patent Application No. 30 48 304. At its combustion chamber side section, configured as a valve-closure member, the valve needle, together with a valve-seat surface, forms a sealing seat, which separates the injection orifices from a fuel supply. The auxiliary needle, guided in the valve needle, also has a valve-closure member, which cooperates with a second valve-seat surface of the fuel injector. A spring, arranged in the valve needle, pulls the auxiliary needle against the valve needle, toward which, together with a valve-seat surface, it also forms a sealing seat in the valve needle. When the hydraulically operated fuel injector begins to open due to an increase in pressure in the fuel line, the auxiliary needle is pressed from its sealing seat in the valve needle against the sealing seat in the valve body, sealing a group of injection orifices, while another group of injection orifices is opened. If the pressure further increases, the valve needle is raised from its sealing seat, and after a certain lift picks up the auxiliary needle, which strikes a stop of the valve needle. All injection orifices may then be opened. Consequently, a total of three precisely manufactured sealing seats may be required. Also, with this conventional fuel injector, merely two groups of injection orifices may be controlled separately.

A fuel injector having two valve needles, in order to open injection orifices in two groups, is described German Published Patent Application No. 31 20 044. Here one valve needle is guided inside the other valve needle, which is configured as a hollow needle. This valve needle, configured as a hollow needle, has injection orifices at its end on the combustion chamber side. The manufacture of the hollow needle may be very complex, because the hollow needle also has injection orifices, and therefore one component may combine two functions, which may require a precise manufacture of the component.

SUMMARY OF THE INVENTION

A fuel injector according to an example embodiment of the present invention may provide a cost-effective, and with regard to manufacturing engineering an easily implementable, method of controlling the injection orifices to be opened, since not only may the injection orifices not require another precisely manufactured sealing seat in order to be opened separately, but also the injection orifices, assigned to a valve section, may be opened independently if the respective heating element of the valve section is controlled separately from the valve-closure member. At a maximum, all injection orifices may thus be selected separately if all injection orifices are assigned a respective valve section and the respective heating elements are controllable separately from one another. As soon as the valve-closure member opens, only the injection orifices not covered by their valve sections may inject fuel.

In particular, the distribution of fuel in the jet pattern of the fuel injector may be influenced by the selection of the injection orifices.

At least the valve section of the disk element may be made of bimetal and the lamination of the bimetal may be configured so that the valve section clears the injection orifices when heated.

Alternatively, the valve section of the disk element may be made of bimetal and the lamination of the bimetal may be configured so that the valve sections of the disk element cover the injection orifices when heated.

In an example embodiment at least the valve section of the disk element is made of a shape memory alloy, in particular a shape memory alloy having a two-way effect.

The heating elements may include resistance wires arranged on the valve sections.

At a maximum, all valve sections of the disk element may be separately selected and opened, if a separate control line is provided for each of the resistance wires.

The valve-seat member or the injection orifice plate may have a second hole circle of injection orifices, arranged radially outside of the first hole circle, and correspondingly shaped valve sections of the disk element may be assigned to the injection orifices of the second hole circle.

The injection orifices may have different injection angles, orifice diameters, and axial lengths.

BRIEF DESCRIPTIONS OF THE DRAWINGS

DETAILED DESCRIPTION

Figure 1:
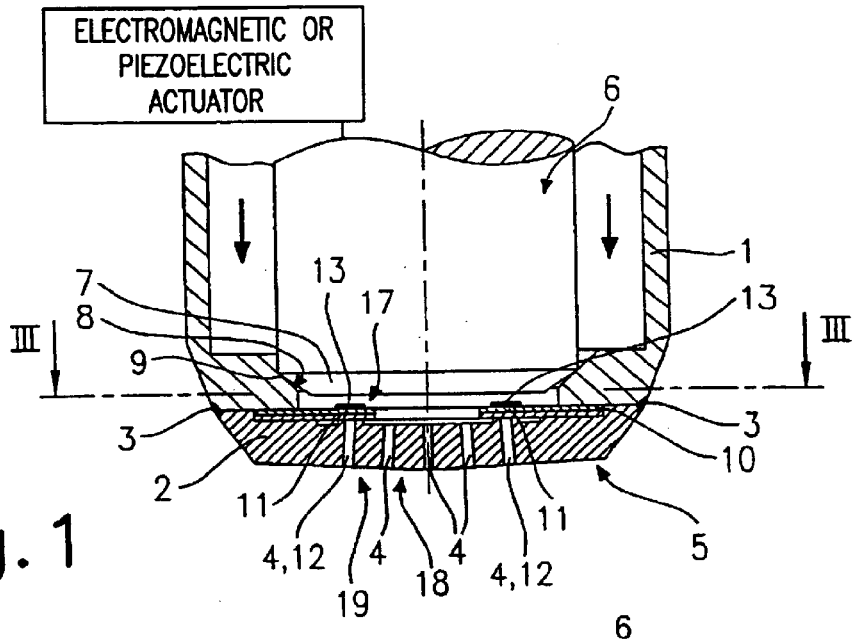
FIG. 1 shows a sectional view through a detail of an example embodiment of a fuel injector according to the present invention having a closed valve needle and covered injection orifices.

FIG. 1 shows in a sectional view a detail of the section of a fuel injector according to an example embodiment of the present invention, facing the combustion chamber of an internal combustion engine, not shown here.

A valve body 1 is connected via weld 3 to injection orifice plate 2, which has injection orifices 4, together forming valve-seat member 5. A valve needle 6 has a valve-closure member 7 at its end facing the combustion chamber, not shown here. Valve-closure member 7 cooperates with valve-seat surface 8, shaped as a frustum of a cone, for example, arranged in valve body 1, to form sealing seat 9. A disk element 10 is arranged on injection orifice plate 2 and is held on injection orifice plate 2 by valve body 1. Disk element 10 has radially inwardly protruding valve sections 11, which, arranged in hole circle 19, cover outer injection orifices 12 at normal operating temperature. Heating elements 13 are arranged on valve sections 11. Valve sections 11 are configured as tongues 17 pointing radially to the center. In the example embodiment, disk element 10 is made of bimetal, whose lamination is formed so that valve sections 11 cover outer injection orifices 12 at low temperature, when heating elements 13 do not additionally heat valve sections 11.

FIG. 1 shows the fuel injector in its closed state. Heating elements 13 are not controlled, and valve sections 11 of disk element 10 have the normal operating temperature or lower. The configuration of the bimetal causes valve sections 11 to be pressed onto the injection orifices 12 arranged in a circle and closes them. If valve needle 6 is now raised from sealing seat 9, fuel may then flow out of uncovered injection orifices 4, e.g., an inner hole circle 18. Injection orifices 4 alone may determine the jet pattern of the fuel.

Figure 2:
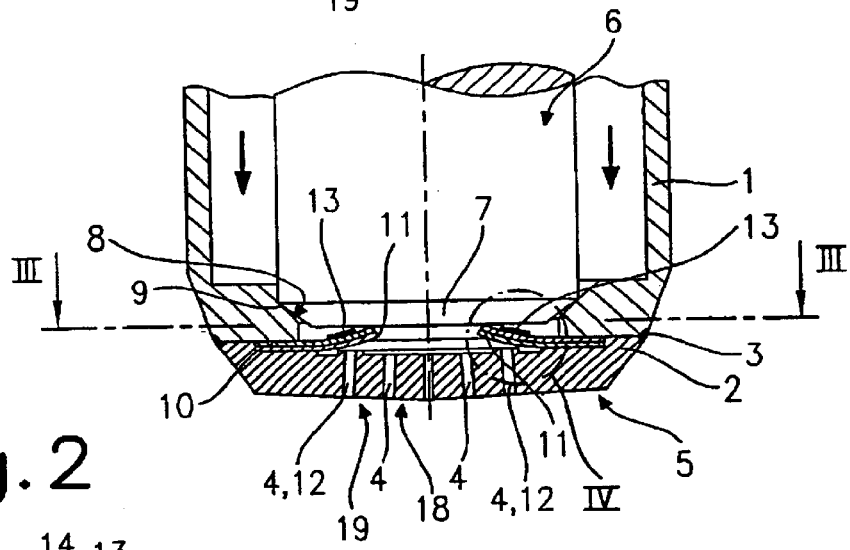
FIG. 2 shows the same detail as in FIG. 1 having cleared injection orifices.

FIG. 2 illustrates the same example embodiment of the present invention. The drawing shows the same detail; therefore, the same components are identified by the same reference numbers. However, the fuel injector is illustrated having valve sections 11 of disk element 10 activated by heating.

Valve body 1 is connected to injection orifice plate 2 containing injection orifices 4 via weld 3, and forms valve-seat member 5. Valve needle 6 together with valve-closure member 7 is configured in one piece. Valve-closure member 7 cooperates with valve-seat surface 8, formed in valve body 1, to form sealing seat 9. Disk element 10 is arranged on injection orifice plate 2 and is held on injection orifice plate 2 by valve body 1. Valve sections 11 and respective heating elements 13 are arranged over outer injection orifices 12 which form second hole circle 19.

The fuel injector is illustrated in its closed state. Heating elements 13 additionally heat valve sections 11. Thus, valve sections 11 bend away from respective injection orifices 12 and clear them. If valve needle 6 is now raised from sealing seat 9, the fuel may flow out of all uncovered injection orifices 4, 12. Two valve sections 11, clearing their respective outer injection orifices 12, are illustrated. Thus, the number of separately clearable injection orifices may depend solely on the possibility of controlling heating elements 13 separately. The number of injection orifices 12 to be cleared by controlling respective heating elements 13 may be selected during the period when the fuel injector is closed. The fuel injector may be opened by valve needle 6 as accurately and rapidly as a conventional fuel injector.

Figure 3:
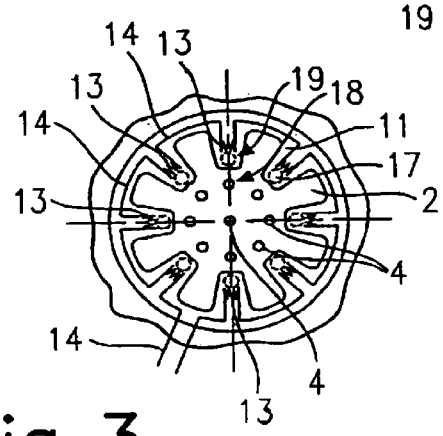
FIG. 3 shows the plane of section III—III in FIG. 1 in top view.

FIG. 3 shows the plane of section III—III of FIG. 1. Injection orifices 4 are arranged in injection orifice plate 2. Valve sections 11 cover outer injection orifices 12. Heating elements 13 are arranged on valve sections 11. Heating elements 13 are configured as resistance wires, for example, being connected via a common lead wire 14. For outer hole circle 19, heating elements 13 may be actuated together in this example embodiment of the present invention.

Figure 4:
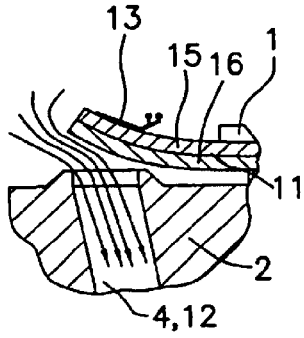
FIG. 4 shows sectional detail IV from FIG. 2.

FIG. 4 shows the detail IV of FIG. 2. Injection orifice 4, being an outer injection orifice 12, is arranged in injection orifice plate 2. Valve section 11 is heated by heating element 13 and therefore is raised from outer injection orifice 12. The edge of valve body 1 securing disk element 10 and valve section 11 is still discernible. Valve section 11, made of bimetal, has an upper layer 15 having less thermal expansion and a lower layer 16 having greater thermal expansion. The direction of flow of the fuel, when the fuel injector is opened, is marked by arrows.

Alternatively, valve section 11 may also be made of a shape memory alloy, one, in particular, having a two-way behavior. Here, the deformation may be a function of the temperature increase and may be reversible when the temperature decreases.

The angle of a fuel injection cone may overall be influenced by a different configuration of the angles at which outer injection orifices 12 and remaining injection orifices 4 are placed. The example embodiment of a fuel injector according to the present invention may make a high switching rate possible. The example embodiment according to the present invention may also be implementable in a cost-effective manner.

What is claimed is:

1. A fuel injector, comprising:

a valve-seat member including a valve-seat surface;

a valve-closure member for cooperating with the valve-seat surface to form a sealing seat;

a structure including a plurality of injection orifices arranged downstream from the sealing seat and sealed from a fuel supply by the sealing seat;

a heating element;

a disk element arranged downstream from the sealing seat and having at least one valve section that changes a shape thereof when a temperature changes, the at least one valve section being connected to the heating element and being able to cover at least one of the injection orifices;

wherein the at least one valve section is configured as a radially inwardly oriented tongue of the disk element, and a portion of the injection orifices arranged in an outer hole circle is assigned to the at least one valve section.

2. The fuel injector according to claim 1, wherein the fuel injector is used for a fuel injection system of an internal combustion engine.

3. The fuel injector according to claim 1, wherein the at least one valve section includes a bimetal.

4. The fuel injector according to claim 3, wherein the bimetal includes a lamination for causing the at least one valve section to unblock the injection orifices when heated.

5. The fuel injector according to claim 3, wherein the bimetal includes a lamination for causing the at least one valve section to cover the injection orifices when not heated.

6. The fuel injector according to claim 1, wherein the at least one valve section includes a shape memory alloy.

7. The fuel injector according to claim 6, wherein the shape memory alloy provides a two-way effect.

8. The fuel injector according to claim 1, wherein the heating element includes an electric heating wire arranged on the at least one valve section.

9. The fuel injector according to claim 1, further comprising:

an injection orifice plate, wherein the injection orifices are arranged in an inner hole circle and in the outer hole circle on one of the valve-seat member and the injection orifice plate.

10. The fuel injector according to claim 1, wherein the injection orifices have different injection angles.

11. The fuel injector according to claim 1, wherein the injection orifices have at least one of different opening diameters and different axial lengths.

12. The fuel injector according to claim 1, further comprising:

a valve needle; and one of an electromagnetic actuator and a piezoelectric actuator, wherein:

the valve-closure member is actuatable via the one of the electromagnetic actuator and the piezoelectric actuator.

13. The fuel injector according to claim 1, further comprising:

a valve body including the sealing seat; and an injection orifice plate firmly connected to the valve body, wherein the injection orifices are formed in the injection orifice plate.

* * * * *